United States Patent [19]

Dalby

[11] 4,342,037

[45] Jul. 27, 1982

[54] DECOUPLING MEANS FOR MONOPOLE ANTENNAS AND THE LIKE

[75] Inventor: Thomas G. Dalby, Bellevue, Wash.

[73] Assignee: The Boeing Company, Seattle, Wash.

[21] Appl. No.: 180,558

[22] Filed: Aug. 22, 1980

[51] Int. Cl.[3] ..... H01Q 1/48

[52] U.S. Cl. ..... 343/846; 343/830

[58] Field of Search ..... 343/846, 791, 790, 830, 343/829, 708, 705

[56] References Cited

U.S. PATENT DOCUMENTS

| | | | |
|---|---|---|---|
| 2,184,729 | 12/1939 | Bailey | 343/846 |
| 2,239,909 | 4/1941 | Bushbeck et al. | 343/861 |
| 2,297,512 | 9/1942 | von Baeyer | 343/791 |
| 2,297,513 | 9/1942 | von Baeyer | 343/791 |
| 2,359,620 | 10/1944 | Carter | 343/795 |
| 2,452,202 | 10/1948 | Lindenblad | 343/854 |
| 3,054,107 | 9/1962 | Engel et al. | 343/761 |
| 3,293,646 | 12/1966 | Brueckmann | 343/791 |

*Primary Examiner*—David K. Moore

*Attorney, Agent, or Firm*—D. T. Anderson; B. A. Donahue

[57] ABSTRACT

A monopole antenna or the like including a sleeve antenna and a stub antenna having means for decoupling the antenna from surrounding electrically conductive elements. Such elements may consist, for example, of the conductive skin of an aircraft and, typically, of other antennas mounted on this skin, or they may comprise conductive portions of a ship. In order to provide the decoupling, a radial transmission line is disposed at the base of the antenna and concentric with the coaxial transmission line used to excite the antenna. The radial transmission line includes an upper and a lower electrically conductive plate, each having a small central opening and means for electrically interconnecting the plates about the opening. The antenna may be fed by a coaxial transmission line extending through the conductive element and the central opening. The inner conductor of the coaxial transmission line may extend beyond the radial transmission line to form a monopole antenna. Alternatively, the coaxial line may extend through the radial line to form a sleeve antenna with an extending monopole structure.

16 Claims, 10 Drawing Figures

Fig. 4
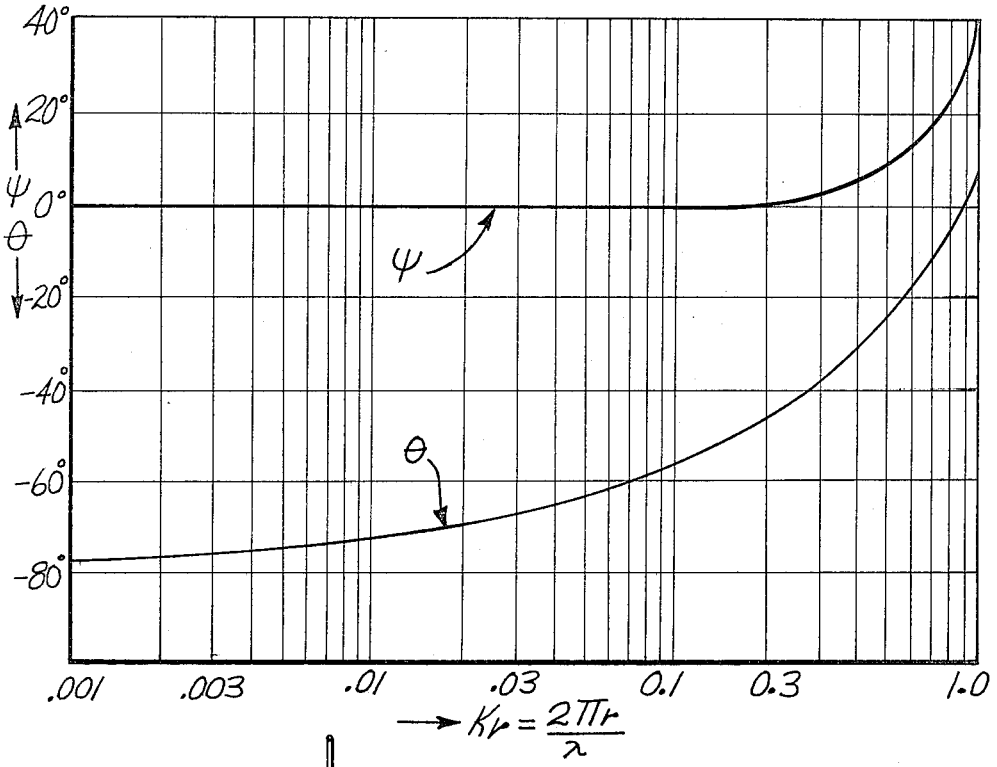
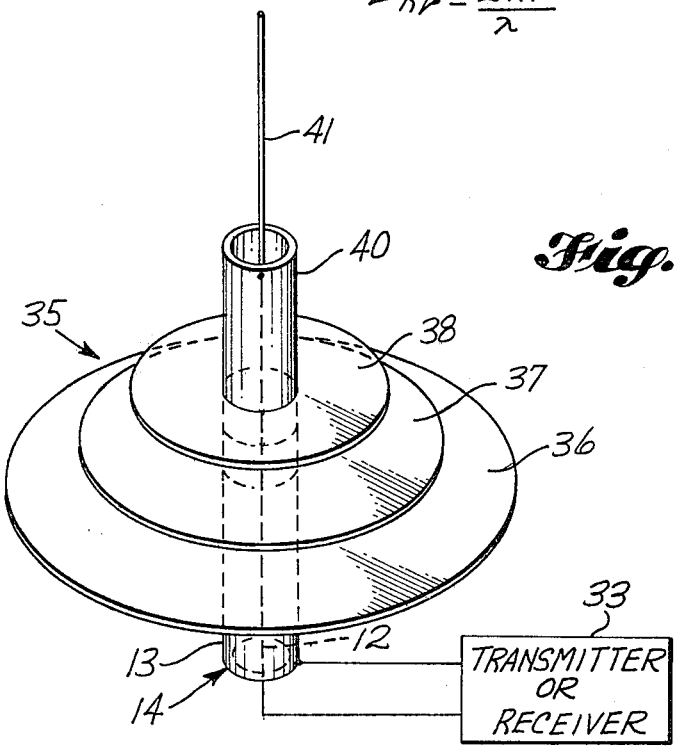
Fig. 5

Fig. 6
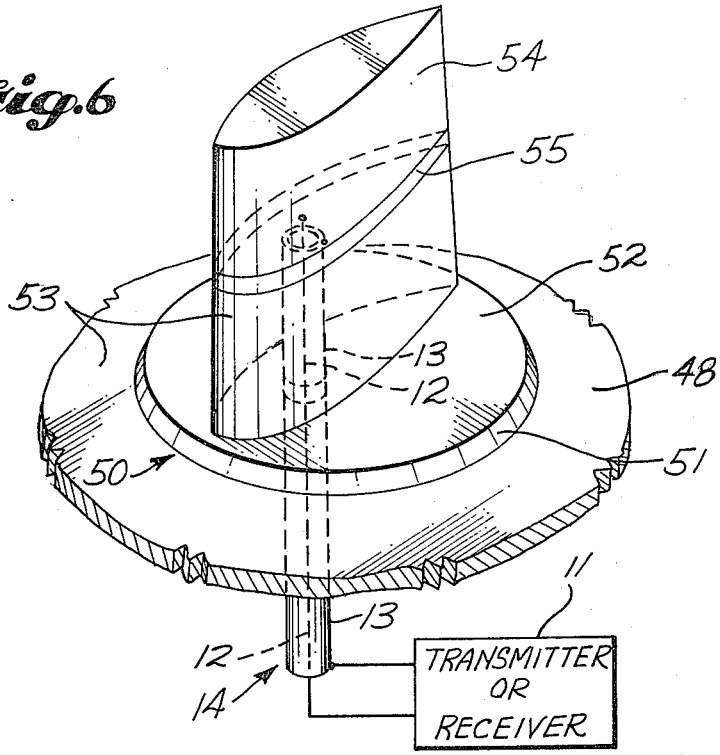
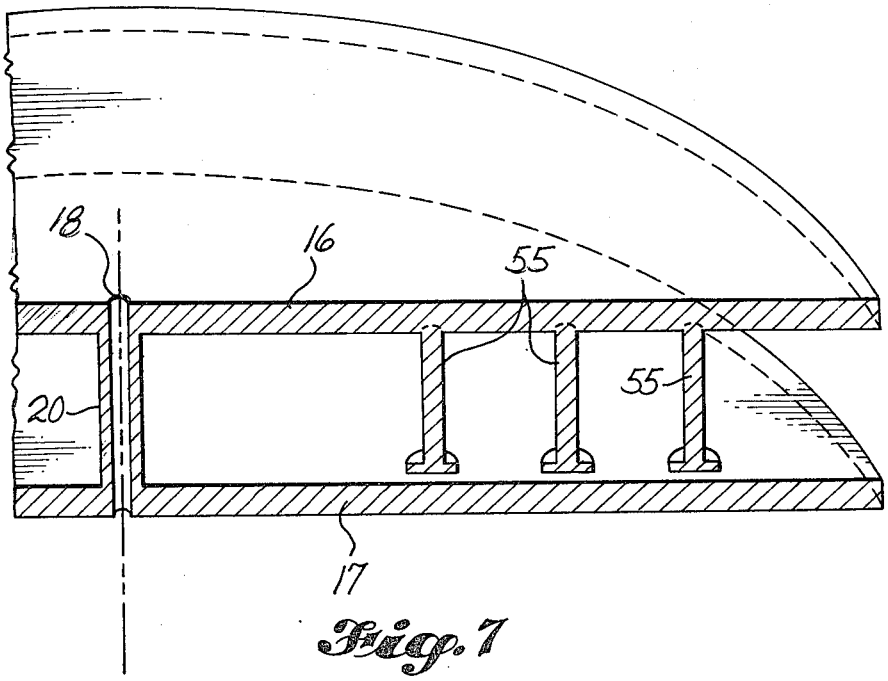
Fig. 7

DECOUPLING MEANS FOR MONOPOLE ANTENNAS AND THE LIKE

BACKGROUND OF THE INVENTION

The present invention relates generally to antennas and particularly to a stub-type, monopole or sleeve-type antenna having means for decoupling it from surrounding conductive bodies.

It is frequently desired to install an antenna particularly for the transmission of high-powered signals in the UHF (300 to 3,000 MHz), VHF (30 to 300 MHz), or HF (3 to 30 MHz) bands on aircraft or ships in such a way as to minimize interference due to electromagnetic energy coupled into other electrical equipment or wiring. This problem is conventionally solved by the provision, over a required frequency range, of a very high impedance at the base of a stub, monopole, or whip antenna. This has been accomplished previously through use of a quarter-wave choke having a configuration similar to that of a coaxial transmission line. Such quarter-wave chokes are well known in the art, as exemplified, for example, by the patents to von Baeyer U.S. Pat. Nos. 2,297,512 and 2,297,513.

The principal disadvantage of such a construction is that the antenna is approximately one-quarter wavelength greater in height than the antenna without a choke. At long wave lengths, such as on the order of one to ten meters or more, difficult installation problems result. Furthermore, a quarter-wave choke causes undesirable effects on the monopole radiation pattern. However, these effects may be largely overcome by the use of a sleeve dipole antenna.

The patent to Buschbeck et al., U.S. Pat. No. 2,239,909, covers an antenna having a coaxial transmission line support. The antenna is basically a monopole antenna. Surrounding the coaxial feed line is an open circular box-like structure. This structure is excited at the inner rather than the outer periphery. The structure requires mounting so that the lower surface is exposed. Hence it could not be installed on a large conductive surface such as an airplane skin.

The patent to Carter, U.S. Pat. No. 2,359,620, discloses a short wave antenna. It consists of two opposed circular discs which are fed from the transmitter. The configuration is excited at the center and the structure is the radiating device and does not serve the purpose of isolation.

The Australian patent, No. 156,778, to Willoughby discloses an antenna structure similar to that of the Carter patent. The patent, however, describes multiple, different means of excitation. The device, again, becomes an effective radiating device or antenna rather than being used as a choke.

The patent to Lindenblad, U.S. Pat. No. 2,452,202, relates to an rf switching device which incorporated coaxial stubs and a circular resonant plate. However, the circular plate must be at least one wavelength in circumference, so that it can sustain a higher mode. This will generate an electric field which varies with azimuth.

The patent to Engle et al., U.S. Pat. No. 3,054,107, does describe an antenna making use of a radial line utilized as a choke. However, the radial line is excited at its inner radius disposed in the rotating joint of a coaxial feed line, and is not designed to utilize the characteristics provided by a very small inner radius in a radial line.

SUMMARY OF THE INVENTION

In the present invention, there is provided a monopole antenna which includes a sleeve-type antenna. There is further disclosed a stub antenna. In accordance with the present invention, each of these antennas is provided with a radial transmission line which serves the purpose to create a high impedance at its base over a range of frequencies, thereby to isolate electrically the antenna from other conductive structures over said range of frequencies.

For example, a monopole antenna may be disposed on an electrically conductive element such as the skin of an aircraft. A coaxial transmission line extends through this element and serves the purpose of feeding energy to, or withdrawing energy from, the antenna, it being understood that an antenna may either radiate energy or receive it.

In accordance with other aspects of the present invention, a radial transmission line is disposed on the conductive element. It conventionally includes an upper and a lower electrically conductive plate or array of one or more straight, curved, or helical wires having a configuration such that its maximum radial dimension is less than one-fourth of the shortest wavelength at which it is to operate. It is understood that the lower electrically conductive plate or array may make electrical contact with the conductive element. The two plates or arrays each have a central opening and are interconnected adjacent the opening by a small conductng element, generally a cylinder, but which may be of any other shape. A monopole antenna may be electrically connected to the inner conductor of the coaxial line which extends through the radial line. Accordingly, the outer periphery of the radial line is excited by the monopole antenna and the radial line is antiresonant at the desired operating frequency of the antenna.

In the case of a sleeve antenna, the coaxial line simply extends beyond the radial line.

In order to lower the resonant frequency, a dielectric may be disposed within the radial transmission line. The radial line may also be tuned by installing one or more posts between or adjacent to the two plates, said posts either making contact with or being insulated from one or both plates. A plurality of radial lines may be superimposed upon each other, each being tuned to a different desired frequency. Finally, a slow wave structure or other form of loading may be incorporated into the radial line for the purpose of lowering the resonant frequency.

The novel features that are considered characteristic of this invention are set forth with particularity in the appended claims. The invention itself, however, both as to its organization and method of operation, as well as additional objects and advantages thereof, will best be understood from the following description when read in connection with the accompanying drawings.

BRIEF DESCRIPTION OF THE DRAWINGS

FIG. 4 is a chart showing the phase angles $\Psi$ and $\theta$ plotted as a function of Kr as defined in FIG. 4;

FIG. 5 is a view in perspective of an example of a sleeve dipole antenna having a plurality of radial transmission lines superimposed upon each other;

FIG. 6 is a view in perspective of an example of the invention embodying a stup-type aircraft antenna with its feed:

FIG. 7 is a cross-sectional view similar to that of FIG. 2 and illustrating a plurality of posts which may depend from either the upper or lower plate of the radial line in order to provide capacitive loading and serve as a slow wave structure;

DESCRIPTION OF THE PREFERRED EMBODIMENTS

Figure 1:
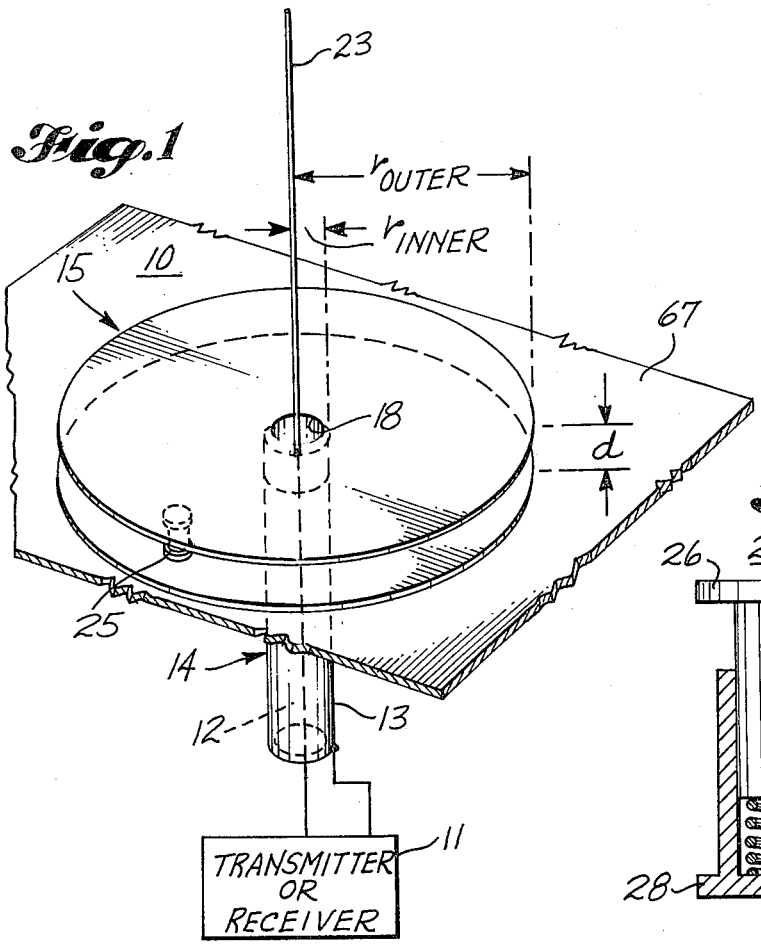
FIG. 1 is a view in perspective of an example of decoupling apparatus for a monopole antenna constructed in accordance with the principles of the present invention.
Figure 3:
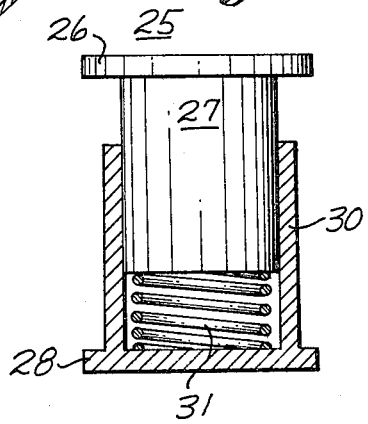
FIG. 3 is a sectional view of the construction of an expansible post which may be inserted into the radial transmission line and the position of which may be varied.
Figure 2:
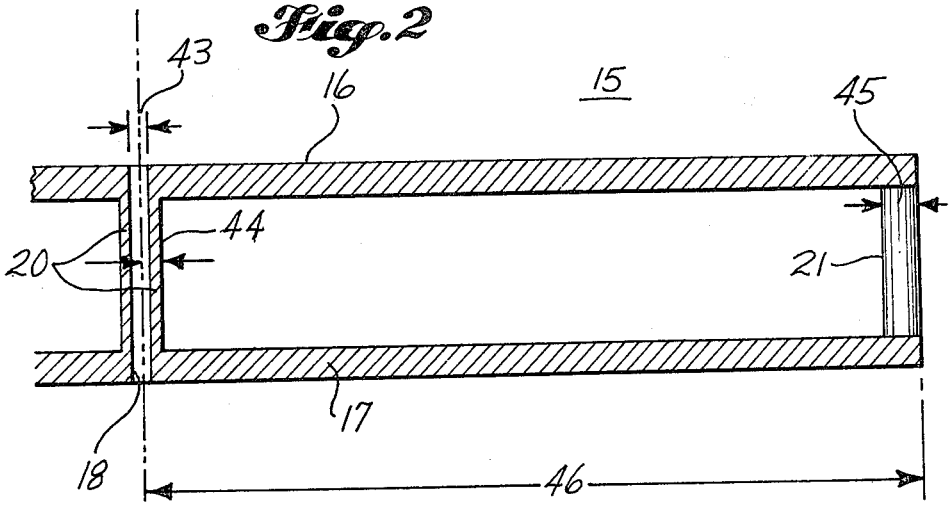
FIG. 2 is an enlarged cross-sectional view of a portion of an example of a radial transmission line serving as a choke.

Referring now to the drawings and particularly to FIGS. 1 through 3, there is illustrated, by way of example, a monopole antenna 10 embodying the present invention. The antenna 10 includes a receiver or transmitter 11 connected between the inner conductor 12 and the outer conductor 13 of a coaxial transmission line 14.

There is further provided a radial transmission line 15. The radial transmission line 15 consists of an upper plate 16 (FIG. 2), a lower plate 17, both being provided with a central opening 18. The plates 16, 17 are shown as circular; however, they may be of any shape such as elliptical, polygonal, or other, or may be composed of an array of one or more straight, curved, or helical conductive wires. The two plates 16 and 17 are conductively connected by a structure 20 which must have a maximum radius smaller than one-tenth of the shortest wavelength at which the device is to operate and which forms the opening 18. In other words, the radial line is short-circuited at its inner radius. A plurality of dielectric posts 21, of which four may be used, support the two plates 16 and 17 at their outer periphery.

It is understood that the outer conductor 13 of the coaxial transmission line 14 is connected electrically to the structure 20 or to at least one of the plates 16 and 17. In the case of the monopole antenna, the inner conductor 12 of the coaxial line 14 extends beyond the radial transmission line 15, as shown at 23. The coaxial transmission line 14 must have such dimensions that at least the dielectric sleeve of the coaxial transmission line or a reduced radius of such a sleeve, said reduced radius still to be consistent with the required power transmission capabilites of the coaxial line, will pass through the opening 18; it being understood that if the outer conductor of the coaxial transmission line does not extend through the opening 18 and make electrical connection thereto, then said outer conductor must make electrical connection to the lower plate or to the larger conductive element which serves as the loweer plate.

It should be noted that FIG. 1 also illustrates the inner radius $r_{inner}$, the outer radius $r_{outer}$, and the height or thickness d of the radial transmission line. A post 25 may be disposed in the radial transmission line 15 and may, for example, be used for purposes of tuning the radial line.

By way of example, FIG. 3 illustrates the construction of an expandable post 25. It has an upper portion 26 with an outer flat surface and a piston 27 which extends into a lower portion 28 having a hollow receptacle 30 for receiving the piston 27. A spring 31 tends to expand the two portions 26 and 28. Accordingly, the post 25 may be initially compressed and inserted between the two plates 16 and 17 of the radial transmission line.

The monopole antenna of FIGS. 1 and 2 is particularly suitable for wavelengths greater than one meter. It will be understood that the radial transmission line is antiresonant and is effective over a certain frequency range as a choke. It presents a high input impedance.

The inner radius of the radial transmission line $r_{inner}$ should be on the order of $0.1\lambda$ or less, where $\lambda$ is the operating wavelength. In the case of circular geometry the outer radius $r_{outer}$ preferably is less than $\lambda/2\pi$ or $0.159\lambda$ in order to avoid excitation of modes with azimuthal dependence. The height of the radial transmission line d preferably is substantially less than the value of $r_{outer}$.

Radial transmission lines have been dealt with in the book by S. Ramo and J. Whinnery, *Fields and Waves in Modern Radio,* Wiley and Sons, 1944, pp. 354 through 360 and also 325 through 327, referred to on page 355. The complex Hankel functions define (p. 356), among others, the phase angles $\Psi$ and $\theta$. In order for the input impedance to be large, the difference in phase angles $\Psi(Kr_{outer})-\theta(Kr_{inner})$ should be as close as possible to 90°. K is defined as $2\pi\lambda$.

In this connection, reference is made to FIG. 4 which shows the phase angles $\Psi$ and $\theta$ as a function of Kr. It will be evident that for $r_{outer}$ a large value may be selected so that the angle $\Psi$ may be as large as 20°, while for $r_{inner}$ a small value may be selected so that $\theta$ may be as low as $-70°$. Hence, the difference between the two angles should be in the neighborhood of 90°. Preferably, $Kr_{outer}$ should be smaller than 1. As noted above, this latter condition prevents excitation of higher-order modes.

When the antenna is excited, the monopole antenna in turn excites the periphery of the radial line in the dominant E-mode. This represents a TEM mode when the wave propagates in the r direction.

For a typical application with a wavelength of 30 meters, $r_{inner}$ may be as low as $3\times10^{-4}\lambda$. This means that $Kr_{inner}$ equals $2\times10^{-3}$. Accordingly, $r_{inner}$ equals 9 mm. Assuming a thickness of the inner wall 20 of 5.4 mm, the opening 18 is 7.2 mm. This will accommodate dielectrics of various standard coaxial cables with power ratings of up to 10 kw. In this case the outer radius may be $0.10\lambda$ with $Kr_{outer}$ equaling 0.63.

It should be noted that in determining the resonant frequency of the radial line the effective $r_{outer}$ is increased by 0.35 d, provided the radial line consists of two plates of equal size or 0.7 d if the line consists of one plate over a larger conducting surface. Thus, the physical value of $r_{outer}$ required to produce a resonant condition is reduced significantly.

The antenna of the invention may also be used to provide attenuation at different frequencies. This has been illustrated in FIG. 5, to which reference is now made. The antenna of FIG. 5 again includes a coaxial transmission line 14. A generator 33 has been shown to excite the transmission line, but it will be understood that it may be replaced by a receiver.

The antenna of FIG. 5 includes a radial line structure 35 consisting of three radial lines 36, 37, and 38. The elements of the radial lines 36, 37, 38, are shown as circular or elliptical but may be of any shape or may be composed of an array of one or more wires. It will be noted from FIG. 5 that the elements have successively smaller sizes corresponding to different frequency ranges. Hence, the three radial lines 36, 37, 38, provide isolation at multiple frequencies without substantially increasing the space requirements.

The transmission line 14 may extend beyond the radial line 38, as shown at 40, to provide a sleeve-type antenna. The inner conductor of the radial transmission line extends beyond the sleeve 40 as shown at 41. It will be understood that the antenna of FIG. 1 may also be changed into a sleeve antenna. The sleeve dipole antenna of the type shown in FIG. 5 minimizes undesirable effects which may otherwise occur on the antenna radiation pattern and input impedance.

It should be noted that calculations would seem to indicate that a great degree of symmetry between the coaxial and the radial lines should be provided. However, experiments have shown that the decoupling is highly tolerant of unsymmetry. This is primarily due to the fact that the circumference or peripheral extent of the plate or plates comprising the radial line is less than the shortest wavelength at which the line is to provide a high impedance. This in turn means that higher modes cannot propagate at any greater wavelengths.

With the antenna shown in FIGS. 1 and 2, experiments have been conducted where the diameter 43 was 3 mm, the radius 44 was 3.2 mm, the thickness 45 of the post 21 was 6 mm, the thickness of each plate 16 and 17 was 5 mm and the distance 46 was 13 cm. The resonant frequency of this line was calculated to be 255 MHz and measured at 241 MHz. The central opening 18 would accommodate the dielectric of a standard coaxial line RG 58/U. The device provided a maximum of 30 db decoupling and greater than 10 db over a 6 percent bandwidth.

As previously mentioned, it is also feasible to provide dielectric loading of the radial line. This has been illustrated in FIG. 6 in connection with a stub-type aircraft antenna. As shown in FIG. 6, there is a conductive element 48 such, for example, as an airplane skin. This conductive element 48 is not required to be planar throughout the area under the plate; it could be a portion of a cylinder, typically such as an aircraft fuselage. A transmitter or receiver 11 is provided which feeds a transmission line 14 extending through the skin 48. The radial transmission line 50 is formed of a dielectric material 51 which is directly applied to the skin 48 and is terminated by an upper conductor 52. The dielectric material may be aerodynamically shaped to reduce wind resistance. Thus, the radial line consists of the skin 48, the dielectric material 51, and the upper conductor 52 with the transmission line 14 passing through the upper conductor 52.

The stub antenna typically consists of two portions; that is, a lower portion 53 and an upper portion 54 insulated and spaced from each other by a dielectric section 55. The inner conductor 12 of the transmission line 14 is connected to the upper stub portion 54. The outer conductor 13 is connected to the lower stub portion 53.

A monopole antenna was built to determine the effects of dielectric loading. This antenna was $r_{outer}$ equal to 6.1 cm, $r_{inner}$ equal to 3.2 mm and d equal to 2.5 cm. This structure was filled with a flat cylinder of nylon of $\sqrt{\epsilon}=1.7$. The quarter wave resonant frequency of the radial line was predicted to be 360 MHz with the nylon cylinder in place. The measured frequency was 355 MHz.

It was found by experience that an off-center post as shown at 25 in FIG. 1 increases the effective $r_{inner}$ and hence raises the resonant frequency. Thus, the outer post alone increased the $r_{inner}$ and the addition of a second post behind the outer produced a still larger effective minimum radius. It was also found that locating a post external to the periphery of the radial line lowers the resonant frequency.

As previously indicated, the use of a slow wave structure in the radial line allows the use of a significantly smaller radial line. Such a slow wave structure has been shown in FIG. 7. A plurality of posts 55 may be provided, which depend from the upper plate 16, as shown, or from the lower plate. Thus the posts 55 may be electrically connected with the upper plate 16 and spaced from and electrically insulated from the lower plate 17. In a similar fashion posts may be installed so as to be insulated from both plates. It will be understood that a plurality of such posts may be provided. It has been demonstrated by experiment that one or more such posts can reduce the resonant frequency of the radial line to a value as low as 70% of the original resonant frequency without degrading the capability for decoupling.

Figure 8:
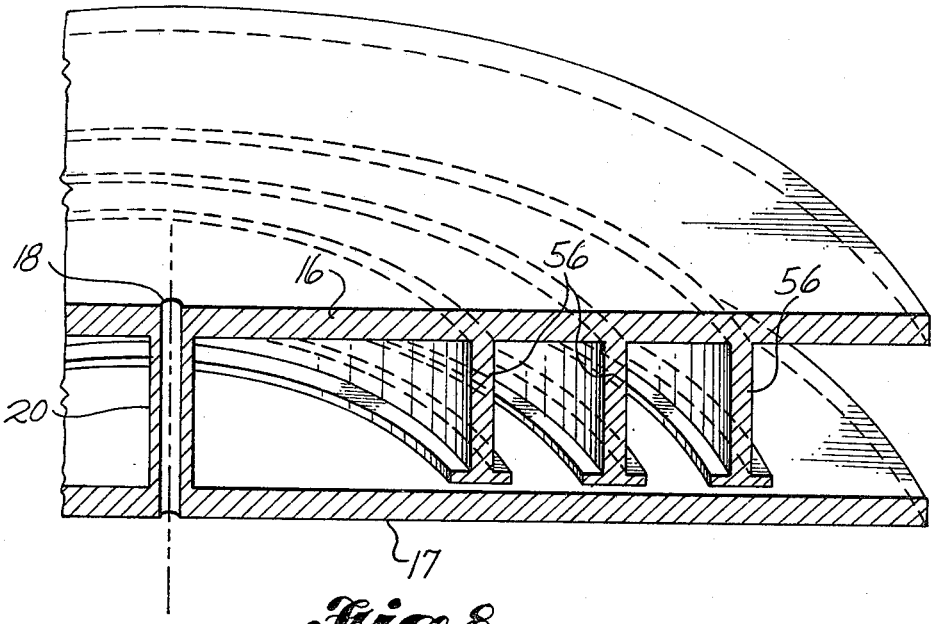
FIG. 8 is a cross-sectional view similar to that of FIG. 7 and showing ridges on the upper plate to serve as a slow wave structure.

FIG. 8 illustrates another type of slow wave structure which may be used. In this case, the upper plate 16 is provided with a plurality of ridges 56, each being of a circular shape and extending around the plate 16. This will also operate as a slow wave structure with the same results as previously described.

Figure 9:
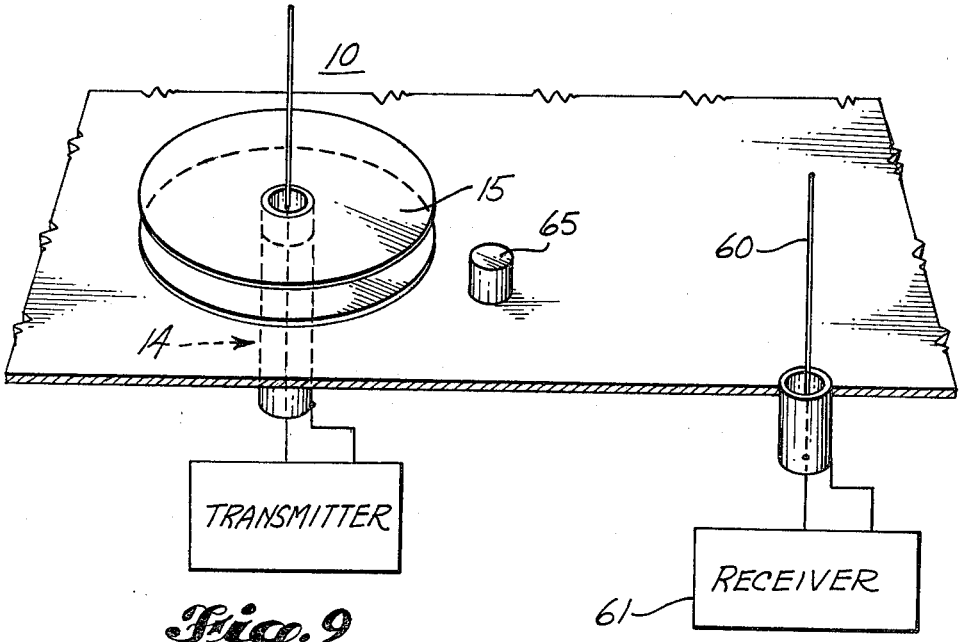
FIG. 9 is a view in perspective of a monopole antenna like that of FIG. 1 with a receiving antenna mounted in the neighborhood of the monopole antenna and a post disposed between the two antennas to further increase the decoupling between the two antennas.

It has also been found that a greater degree of attenuation or decoupling may be provided with the structure shown in FIG. 9, which illustrates a monopole antenna 10 which may take the form shown in FIG. 1. There is also provided an antenna 60 for receiving electromagnetic energy, the antenna being coupled to a suitable receiver 61. An external post or obstacle 65 is disposed between the two antennas 10 and 60. Such an obstacle between the receiving antenna 60 and the radial transmission line 15 may increase the decoupling to more than 40 db. This is due to the fact that higher mode excitation occurs in the space outside the radial line, resulting in a substantial change in configuration of the electromagnetic fields in this region.

Figure 10:
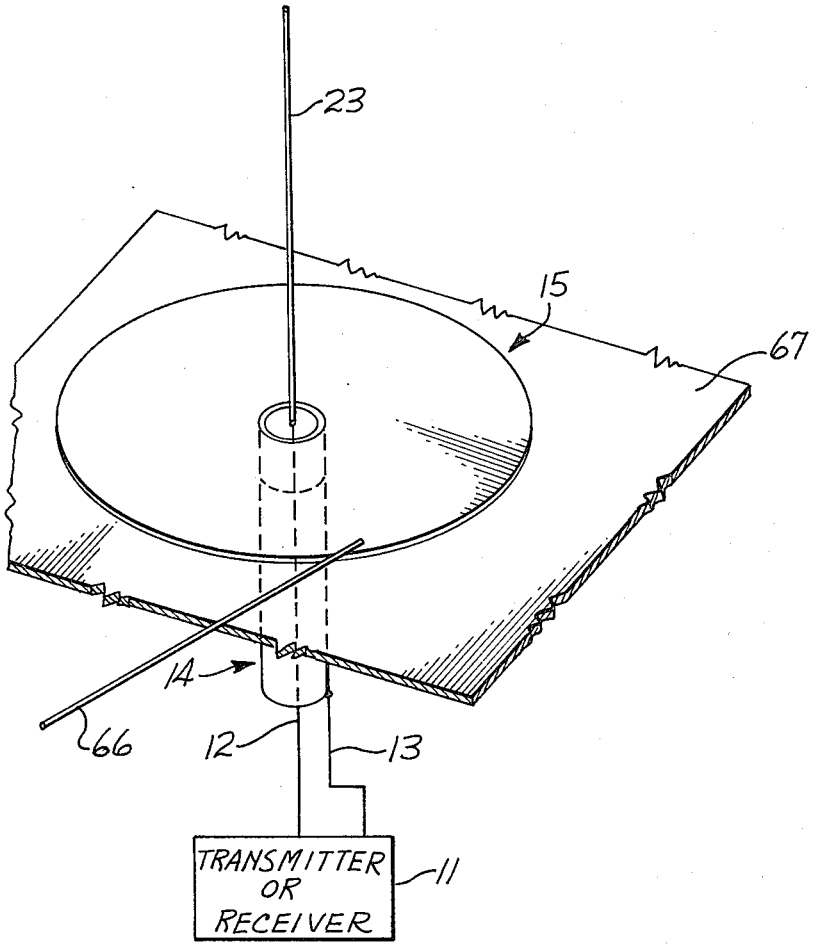
FIG. 10 is a view like that of FIG. 1 of an alternative example of the invention in which a conductive wire is shown affixed to the upper plate of the antenna apparatus.

Finally, it has been found that the tolerance of dissymmetry in the shape of the plates or arrays comprising the radial transmission line is so great that, as shown in FIG. 10, a single wire 66 extending from the upper plate 15 outward over a conducting surface 67 will serve to greatly reduce the resonant frequency of the radial line formed by the plate 15 and the surface 67 yet still will allow the radial line to provide significant decoupling or attenuation. It has been demonstrated by experiment that addition of such a wire extending 30 cm from the edge of the top plate of a radial line, said line being normally resonant at 349 MHz, reduced the resonant frequency to 213 MHz and produced a maximum value of decoupling equal to 15 db.

There has thus been disclosed an antenna such as a monopole, sleeve dipole or stub antenna provided with a radial transmission line to act as a choke. The radial transmission line is characterized by a small inner radius, thus reducing the overall size of it. It is possible to stack several radial lines on top of each other to provide isolation at multiple frequencies. In addition, a slow wave structure or other type of loading may be incorporated into the radial line. Symmetry of neither the excitation source nor the radial line plates is required and the resonant frequency of the radial line may be adjusted by the use of one or more posts. Finally, a dielectric filling may be provided to further improve the properties of the radial transmission line.

What is claimed is:

1. A stub antenna having means for decoupling it from surrounding electrically conductive elements comprising:
   (a) an electrically conductive sheet which is not necessarily planar;
   (b) a dielectric material disposed on said sheet and being contoured to minimize wind resistance;
   (c) an upper conductive plate disposed on said dielectric material, said sheet, material and plate forming a radial transmission line and having a central circular aperture extending therethrough;
   (d) a stub antenna having a lower portion resting on said plate and an upper portion spaced therefrom;
   (e) a second dielectric material for spacing and insulating said stub antenna portions from each other; and
   (f) a coaxial transmission line for feeding the antenna, said coaxial line having an inner conductor electrically connected to the upper portion of said stub antenna and an outer conductor electrically connected to the lower portion of said stub antenna.

2. An antenna having means for decoupling it from surrounding electrically conductive elements comprising:
   (a) an electrically conductive element;
   (b) a coaxial transmission line extending through said element and for feeding energy to or withdrawing energy from the antenna;
   (c) a radial transmission line disposed on said element and including an upper and a lower electrically conductive plate or array of one or more wires defining an effective outer radius, each having a central opening defining an effective inner radius and surrounding said coaxial line and means for electrically interconnecting said plates or arrays about said opening; and
   (d) a monopole antenna electrically connected to the inner conductor of said coaxial line and extending from said radial line, whereby the outer periphery of said radial line is excited by said monopole antenna, said radial line being antiresonant at the desired operating frequency of the antenna.

3. An antenna as defined in claim 2 wherein the effective inner radius of said radial line is less than 0.1 of the operating wave length.

4. An antenna as defined in claim 3 wherein the effective outer radius of said radial line is less than 0.159 of the operating wave length.

5. An antenna as defined in claim 4 wherein the height of said radial line is less than one-half of the outer effective radius of said radial line.

6. An antenna as defined in claim 2 wherein at least one post is disposed between and makes contact with both said upper and lower plates of said radial line.

7. An antenna as defined in claim 6 wherein a post is disposed near the outer periphery of but external to said radial line to reduce the resonant frequency thereof.

8. An antenna as defined in claim 2 wherein the difference of the phase angles of said radial line $\Psi(Kr_{outer})-\theta(Kr_{inner})$ is approximately 90 degrees.

9. An antenna as defined in claim 2 wherein a slow wave structure is incorporated into said radial line to reduce the physical size of said radial line at the same frequency.

10. An antenna as defined in claim 9 wherein said slow wave structure includes a plurality of posts disposed between and capacitively coupled to at least one of said upper and lower plates or arrays.

11. An antenna as defined in claim 9 wherein said slow wave structure includes a plurality of ridges between said plates or arrays which are conductively connected to said upper or lower plate or array.

12. An antenna as defined in claim 2 wherein said radial line is loaded by a dielectric material disposed between said plates or arrays.

13. An antenna as defined in claim 2 wherein a conductive post is disposed on said element and adjacent the radial transmission line for exciting higher modes external to said radial line.

14. An antenna having means for decoupling it from surrounding electrically conductive elements comprising:
   (a) a coaxial transmission line for feeding the antenna;
   (b) a plurality of radial transmission lines disposed one on top of the other, each having a central aperture for passing said coaxial line therethrough, each of said radial lines having an antiresonant frequency different from that of the others; and
   (c) a monopole antenna electrically connected to the inner conductor of said coaxial line and extending from the uppermost one of said radial lines.

15. An antenna as defined in claim 14 wherein said coaxial line extends beyond the uppermost one of said radial lines.

16. An antenna having means for decoupling it from surrounding electrically conductive elements comprising:
   (a) a coaxial transmission line for feeding energy to, or withdrawing energy from, the antenna;
   (b) a radial transmission line having an inner surface closely surrounding said coaxial transmission line; and
   (c) a monopole or stub antenna electrically connected to the inner conductor of said coaxial line and extending from said radial line, whereby the outer periphery of said radial line is excited by said monopole antenna, said radial line being antiresonant at the desired operating frequency range of the antenna.

* * * * *